US012653234B2

(12) United States Patent
Newns et al.

(10) Patent No.: US 12,653,234 B2
(45) Date of Patent: Jun. 16, 2026

(54) SMOKING SUBSTITUTE CONSUMABLE HAVING EXTRUDED CANNABINOID-CONTAINING PLANT MATERIAL

(71) Applicant: Imperial Tobacco Limited

(72) Inventors: David Newns, Liverpool (GB); Chris Lord, Liverpool (GB); Kate Ferrie, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 930 days.

(21) Appl. No.: 17/407,858

(22) Filed: Aug. 20, 2021

(65) Prior Publication Data

US 2021/0378310 A1 Dec. 9, 2021

Related U.S. Application Data

(63) Continuation of application No. PCT/EP2020/053701, filed on Feb. 13, 2020, and a (Continued)

(30) Foreign Application Priority Data

Feb. 22, 2019 (EP) ..... 19020085
Feb. 22, 2019 (EP) ..... 19020086

(51) Int. Cl.
*A24F 40/46* (2020.01)
*A24D 3/17* (2020.01)
(Continued)

(52) U.S. Cl.
CPC ..... *A24F 40/46* (2020.01); *A24D 3/17* (2020.01); *A24F 40/20* (2020.01); *A24F 40/42* (2020.01)

(58) Field of Classification Search
None
See application file for complete search history.

(56) References Cited

U.S. PATENT DOCUMENTS 11,582,996 B2 * 2/2023 Holzer ..... A24F 25/00
11,785,991 B2 * 10/2023 Sur ..... A24F 40/57 131/329

(Continued)

FOREIGN PATENT DOCUMENTS

WO WO 2018/228131 12/2018
WO PCT/EP19/76688 * 2/2019
WO WO 2019/115409 6/2019

OTHER PUBLICATIONS

International Search Report and Written Opinion (PCT/EP2020/053701); Apr. 20, 2020, 11 pages.

(Continued)

*Primary Examiner* — Oscar C Jimenez
(74) *Attorney, Agent, or Firm* — DUNLAP CODDING, P.C.

(57) ABSTRACT

The present disclosure relates to an aerosol-forming article (e.g., a heat-not-burn consumable) comprising an aerosol-forming substrate and one or more of a hollow bore element, a filter element, a spacer element and/or an aerosol-cooling element downstream of the substrate wherein the substrate comprises a cannabinoid-containing plant material.

20 Claims, 7 Drawing Sheets

Related U.S. Application Data continuation of application No. PCT/EP2020/053717, filed on Feb. 13, 2020.

(51) Int. Cl.
*A24F 40/20* (2020.01)
*A24F 40/42* (2020.01)

(56) References Cited

U.S. PATENT DOCUMENTS

| | | | | |
|---|---|---|---|---|
| 11,997,776 | B2 * | 5/2024 | Thorens | H05B 6/108 |
| 2006/0257463 | A1 | 11/2006 | Elsohly | |
| 2015/0136158 | A1 | 5/2015 | Stevens et al. | |
| 2016/0295916 | A1 * | 10/2016 | Malgat | A24F 40/46 |
| 2018/0015237 | A1 * | 1/2018 | Thorens | A24F 40/40 |
| 2018/0177235 | A1 | 6/2018 | Minzoni | |
| 2019/0038853 | A1 | 2/2019 | Eyal et al. | |
| 2021/0219597 | A1 * | 7/2021 | Ferrie | A24D 1/20 |
| 2021/0307383 | A1 * | 10/2021 | Davis | A24D 1/20 |
| 2023/0329316 | A1 * | 10/2023 | Arndt | A24B 15/302 |
| 2023/0404136 | A1 * | 12/2023 | Campitelli | A24F 40/465 |
| 2024/0041100 | A1 * | 2/2024 | Park | A24C 5/28 |

OTHER PUBLICATIONS

International Search Report and Written Opinion (PCT/EP2020/053717); Apr. 23, 2020; 10 pages.

* cited by examiner

SMOKING SUBSTITUTE CONSUMABLE HAVING EXTRUDED CANNABINOID-CONTAINING PLANT MATERIAL

CROSS REFERENCE TO RELATED APPLICATIONS/INCORPORATION BY REFERENCE STATEMENT

This application is a non-provisional application claiming benefit to the international application no. PCT/EP2020/053717 filed on Feb. 13, 2020, which claims priority to EP 19020085.7 filed on Feb. 22, 2019. This application also claims benefit to the international application no. PCT/EP2020/053701 filed on Feb. 13, 2020, which claims priority to EP 19020086.5 filed on Feb. 22, 2019.

FIELD OF THE DISCLOSURE

The present disclosure relates to an article/consumable for use in a smoking substitute system and particularly, although not exclusively, to a heat-not-burn (HNB) consumable.

BACKGROUND

Ingestion of the plant material, *cannabis* (also known as marijuana or hashish) is widely known for both medicinal and recreational purposes. In some countries, recreational use of *cannabis* has been legalized, or is officially tolerated.

*Cannabis* comprises numerous (phyto-)cannabinoids some of which can act on human cannabinoid receptors ($CB_1$ and $CB_2$) to affect physiological processes such as appetite, mood, stress response and muscular/joint pain relief.

Ingestion of *cannabis* is typically through smoking (either alone or mixed with tobacco) and is considered to expose a smoker to potentially harmful substances. It is generally thought that a significant amount of the potentially harmful substances are generated through the heat caused by the burning and/or combustion of the *cannabis* (and tobacco) and the constituents of the burnt *cannabis* (and tobacco) in the smoke itself.

Conventional *cannabis* smoking articles often referred to as "joints" are typically rolled by hand by the user and comprise a roughly cylindrical wad of dried *cannabis* leaves/buds/flowers which is surrounded by a paper wrapper. A filter may or may not be included, axially aligned in an abutting relationship with the wrapped *cannabis* wad. A conventional *cannabis* smoking article of this type is used by lighting the end opposite to the filter, and burning the *cannabis* wad. The smoker receives mainstream smoke into their mouth by drawing on the filter end of the article.

Combustion of organic material such *cannabis* is known to produce potentially harmful by-products. Furthermore, some medicinal effects of *cannabis* are decreased by combustion which can deactivate certain cannabinoids. There have been proposed various smoking substitute systems (or "substitute smoking systems") in order to avoid the smoking of *cannabis*.

Smoking substitute systems for *cannabis* include heat-not-burn (HNB) systems in which a heater heats ground, chopped or loose-leaf *cannabis* plant material contained within a sealed container pod or capsule to produce an aerosol (also referred to as a "vapor") that is drawn into the lungs through the mouth (inhaled) and then exhaled. The inhaled aerosol typically bears cannabinoids without, or with fewer of, the odor and health risks associated with traditional *cannabis* smoking.

However, these known *cannabis* smoking substitute systems do not provide a substitute for the rituals of smoking which is important especially for recreational users.

There is a need for improved design of *cannabis* HNB smoking substitute systems to enhance the user experience and/or increase cannabinoid delivery to the user.

The present disclosure has been devised in light of the above considerations.

SUMMARY OF THE DISCLOSURE

First Mode: An Aerosol-Forming Article, Wherein the Article Comprises a Substrate Comprising a Cannabinoid-Containing Plant Material At its most general, a first mode of the present disclosure relates to an aerosol-forming article, e.g., a consumable for use in a smoking substitute system and particularly, although not exclusively, to a heat-not-burn (HNB) consumable, wherein the article/consumable comprises a substrate comprising a cannabinoid-containing plant material.

Accordingly, in a first aspect of the first mode, there is provided an aerosol-forming article comprising an aerosol-forming substrate and one or more of a hollow bore element, a filter element, a spacer element and/or an aerosol-cooling element downstream of the substrate wherein the substrate comprises a cannabinoid-containing plant material.

By providing an article having a substrate and one or more of a hollow bore element, a filter element, a spacer element and an aerosol-cooling element, the cooling and the mixing of the vapor generated from the heating of the substrate as it moves towards the downstream/mouth end of the substrate can be optimized.

Optional features will now be set out. These are applicable singly or in any combination with any aspect of the first mode.

The aerosol-forming substrate is capable of being heated to release at least one cannabinoid compound (e.g., a mixture of cannabinoid compounds) that can form an aerosol.

Cannabinoid compounds include phyto-cannabinoids which include:

(1) cannabidiol (CBD) and its derivatives/homologues (e.g., cannabidiol mono(m)ethyl ether, cannabidivarin (CBDV), cannabidiorcol, cannabidiolic acid, cannabidivarinic acid);

(2) cannabinodiol (CBND) and its derivatives/homologues (e.g., carrabinodivarin);

(3) cannabigerol (CBG) and its derivatives/homologues (e.g., cannabigerol mono(m)ethyl ether, cannabinerolic acid A, cannabigerovarin, cannabigerolic acid A, cannabigerolic acid A mono(m)ethyl ether, cannabigerovarinic acid A);

(4) cannabinol (CBN) and its derivatives/homologues (e.g., cannabivarin/cannabivarol (CBV), cannabiorcol, cannabinolic acid, cannabinol (m)ethyl ester);

(5) tetrahydrocannabinol (THC) and its derivatives/homologues (e.g., tetrahydrocannabivarin (THCV), tetrahydrocannabiorcol, tetrahydrocannabinolic acid A/B, tetrahydrocannabivarinic acid A, tetrahydrocannabiorcolic acid A/B, isotetrahydrocannabinol, isotetrahydrocannabivarin);

(6) cannabicyclol (CBL) and its derivatives/homologues (e.g., cannabicyclolic acid, cannabicyclovarin);

(7) cannabichromene (CBC) and its derivatives/homologues (e.g., cannabichromenic acid A, cannabichrornevarin (CBCV), cannabichrornevarinic acid A);

(8) cannabielsoin (CBE) and its derivatives/homologues (e.g., cannabielsoic acid A/B, cannabiglendol, dehydrocannabifuran, cannabifuran);

(9) cannabicitran (CBT) and its derivatives/homologues;

(10) cannabitriol and its derivatives/homologues (e.g., ethyl cannabitriol, dihydroxy-tetrahydrocannabinol, cannabidiolic acid A cannabitriol ester, dihydroxy-hexahydrocannabino (cannabiripso), cannabitetrol, oxo-tetrahydrocannabino); and

(11) cannabichromanone (CBCN) and its derivatives/homologues (e.g., cannabicoumaronone).

In some embodiments, the cannabinoid compound is selected from at least one of cannabidiol (CBD) and its derivatives/homologues, e.g., cannabiodiol-$C_5$ (CBD-$C_5$), cannabidiol-$C_4$ (CBD-$C_4$), cannabidiol mono(m)ethyl ether (CBDM-$C_5$), cannabidivarin (CBDV-$C_3$), cannabidiorcol (CBD-$C_1$), cannabidiolic acid (CBDA-$C_5$), cannabidivarinic acid (CBDVA-$C_3$).

In some embodiments, the cannabinoid compound is selected from at least one of tetrahydrocannabinol (THC) and its derivatives/homologues, e.g., $\Delta^9$-tetrahydrocannabinol ($\Delta^9$-THC-$C_5$/cis-$\Delta^9$-THC-$C_5$), $\Delta^8$-tetrahydrocannabinol ($\Delta^8$-THC-$C_5$), $\Delta^8$-tetrahydrocannabinolic acid A ($\Delta^8$-THCA-$C_5$ A), $\Delta^9$-tetrahydrocannabinol-$C_4$ ($\Delta^9$-THC-$C_4$), $\Delta^9$-tetrahydrocannabivarin ($\Delta^9$-THCV-$C_3$), $\Delta^9$-tetrahydrocannabiorcol ($\Delta^9$-THCO-$C_1$), $\Delta^9$-tetrahydrocannabinolic acid A ($\Delta^9$-THCA-$C_5$ A), $\Delta^9$-tetrahydrocannabinolic acid B ($\Delta^9$-THCA-$C_5$ B), $\Delta^9$-tetrahydrocannabinolic acid-$C_4$ A and/or B ($\Delta^9$-THCA-$C_4$ A and/or B), $\Delta^9$-tetrahydrocannabivarinic acid A ($\Delta^9$-THCVA-$C_3$ A), $\Delta^9$-tetrahydrocannabiorcolic acid A and/or B ($\Delta^9$-THCOA-$C_1$ A and/or B), isotetrahydrocannabinol and isotetrahydrocannabivarin.

The total amount of cannabinoid compounds in the substrate may be at least 200 mg; for example, it may be at least 250 mg, at least 300 mg, at least 400 mg, at least 500 mg. In some cases, lower amounts may be preferred. The total amount of cannabinoid compounds in the substrate may therefore be at least 10 mg, at least 20 mg, at least 30 mg, at least 40 mg, at least 50 mg, at least 75 mg, at least 100 mg.

In some cases, it may be desirable to limited the total amount of cannabinoid compounds, which may be not more than 200 mg, not more than 175 mg, not more than 150 mg, not more than 125 mg, not more than 100 mg, not more than 75 mg, not more than 50 mg, not more than 40 mg, not more than 30 mg, not more than 20 mg, not more than 10 mg. In some cases, the total amount of the cannabinoid compounds may be not more than 5 mg.

Where THC is included, either as one cannabinoid compound in a mixture or as the only cannabinoid, the total of amount of THC may be limited. In some cases, the total amount of THC in the substrate is not more than 100 mg, not more than 75 mg, not more than 50 mg, not more than 40 mg, not more than 30 mg, not more than 20 mg, not more than 15 mg, not more than 10 mg, not more than 5 mg, not more than 3 mg. In some cases, the amount of THC may be 0.1 to 30 mg, for example 1 to 30 mg, for example 1 to 20 mg, for example 1 to 10 mg, for example 1 to 5 mg, for example 1 to 3 mg.

The cannabinoid-containing plant material may comprise *cannabis* plant material including *Cannabis sativa, Cannabis indica* and *Cannabis rudealis.*

The cannabinoid-containing plant material may comprise *Echinacea purpurea, Echinacea angustifolia, Acmella oleracea, Helichrysum umbraculigerum*, or *Radula marginata*. This also includes blends of the above-mentioned plant material.

Preferably the cannabinoid-containing plant material is *cannabis.*

The cannabinoid-containing (e.g., *cannabis*) plant may be a traditional strain, or may be a strain bred or other modified (e.g., genetically) to produce certain levels of some cannabinoid compounds, e.g., low levels of THC or high levels of THC.

Any suitable parts of the cannabinoid-containing plant may be used. Thus, the cannabinoid-containing plant material may comprise leaves, stems, roots, bark, seeds, buds and flowers (which may be cured).

The aerosol-forming substrate may comprise at least 50 wt % plant material, e.g., at least 60 wt % plant material, e.g., around 65 wt % plant material. The aerosol-forming substrate may comprise 80 wt % or less plant material, e.g., 75 or 70 wt % or less plant material.

The cannabinoid-containing plant material may comprise leaf plant material, stem plant material, plant material powder/dust, expanded plant material, homogenized plant material, shredded plant material, extruded plant material, or reconstituted plant material (e.g., slurry or paper recon).

The aerosol-forming substrate may comprise a gathered sheet of homogenized (e.g., slurry/paper recon) plant material or gathered shred/strips formed from such a sheet.

In some embodiments, the sheet/web of cannabinoid-containing (e.g., *cannabis*) plant material used to form the aerosol-forming substrate has a sheet weight (grammage) greater than or equal to 100 g/m$^2$, e.g., greater than or equal to 110 g/m$^2$ such as greater than or equal to 120 g/m$^2$.

The sheet/web of cannabinoid-containing (e.g., *cannabis*) plant material may have a grammage of less than or equal to 300 g/m$^2$, e.g., less than or equal to 250 g/m$^2$ or less than or equal to 200 g/m$^2$.

The sheet/web of cannabinoid-containing (e.g., *cannabis*) plant material may have a grammage of between 120 and 190 g/m$^2$.

The aerosol-forming article is preferably a heat-not-burn (HNB) consumable.

The aerosol-forming substrate may be located at an upstream axial end of the article/consumable.

As used herein, the terms "upstream" and "downstream" are intended to refer to the flow direction of the vapor/aerosol, i.e., with the downstream end of the article/consumable being the mouth end or outlet where the aerosol exits the article/consumable for inhalation by the user. The upstream end of the article/consumable is the opposing end to the downstream end.

The aerosol-forming substrate may be at least partly circumscribed by a wrapping layer, e.g., a paper wrapping layer.

The aerosol-forming substrate may be formed in a substantially cylindrical shape such that the article/consumable resembles a conventional cigarette. It may have a diameter of between 5 and 10 mm, e.g., between 6 and 9 mm or 6 and 8 mm, e.g., around 7 mm. It may have an axial length of between 10 and 15 mm, e.g., between 11 and 14 mm such as around 12 or 13 mm.

The aerosol forming substrate may be solid, i.e., it may be un-bored without a hollow core.

The hollow bore element (where present) comprises a hollow bore which extends the axial length of the hollow bore element.

The hollow bore element may be a terminal hollow bore element at the downstream/mouth end of the article/consumable. In these embodiments, the hollow bore terminates at the downstream/mouth end of the article/consumable.

The hollow bore element may be an upstream hollow bore element, i.e., upstream of the downstream/mouth end of the article/consumable (but downstream of the substrate).

The article/consumable may comprise both a terminal and upstream hollow bore element. The terminal and upstream hollow bore elements may be axially adjacent one another or may be axially spaced. The upstream hollow bore element may be axially adjacent, i.e., immediately downstream of the substrate.

The or each hollow bore element may have an axial bore, i.e., aligned with the axis of the hollow bore element.

The terminal hollow bore element (where present) may have a hollow bore which is off-set from the axial center of the terminal hollow bore element. By providing an axially off-set hollow bore in the terminal hollow bore element, the temperature of the vapor entering the user's mouth will be reduced whilst the visible vapor (total particulate matter) will be maintained. As the vapor/aerosol travels through the article/consumable, upon reaching the terminal hollow bore element, it will meet the axial upstream end of the terminal hollow bore element and will be forced to take a convoluted path through the off-set bore. This convoluted path will help mix and cool the vapor/aerosol prior to inhalation.

The terminal hollow bore element may comprise only the single axially off-set hollow bore and no other bores, i.e., the terminal hollow bore element is preferably solid other than for the single off-set hollow bore.

The term "axially off-set" means that the axial center of the hollow bore is not aligned with the axial center of the terminal hollow bore element. The axial center of the terminal hollow bore element may, however, be within the off-set bore.

The or each hollow bore (whether axial or axially off-set) may have a bore diameter of between 1 and 5 mm, e.g., between 2 and 4 mm or between 2 and 3 mm.

Where there is both a terminal hollow bore element and an upstream hollow bore element, they may have different bore diameters. The upstream hollow bore element preferably has a larger bore diameter than the terminal hollow bore element. For example, the upstream hollow bore element may have a bore diameter that is 1 mm or more greater than the bore diameter of the terminal element. For example, the upstream hollow bore element may have a bore diameter of 3 or 3.5 mm whilst the terminal hollow bore element may have a bore diameter of around 2 mm.

By providing a terminal hollow bore element with a reduced bore diameter (compared to the upstream hollow bore element), a greater mixing effect is achieved within the terminal hollow bore element as all of the components of the vapor/aerosol are forced to co-locate within the more restricted hollow bore.

The terminal hollow bore element may have an increased density or increased hardness than the upstream hollow bore element, i.e., the upstream hollow bore element may have an increased porosity than the terminal hollow bore element. This is to increase the flow and mixing of the vapor/aerosol within the hollow bore of the terminal hollow bore element. The increased hardness/reduced porosity of the terminal hollow bore element forces the aerosol/vapor to enter the axial bore through the terminal hollow bore element (since the passage through the body of the terminal hollow bore element is impeded) and this forces the components within the vapor/aerosol to co-locate within the bore thus increasing mixing.

Hardness can be measured using a standard densitometer such as a Borgwaldt densitometer DD60A. During such measurement, the diameter of the hollow bore element is measured and then a crushing load (e.g., 3 kg) is applied and the remaining diameter (parallel to the applied force) measured after a given time. A percentage hardness is calculated as the remaining diameter divided by the initial diameter ×100.

In some embodiments, the percentage hardness of the terminal hollow bore element is 3% or more, 4% or more or 5% or more greater than the hardness of the upstream hollow bore element.

The or each hollow bore element may be formed of a smoke permeable (porous) material such as cellulose acetate or polypropylene tow, paper or plant material or may be formed of smoke impermeable (non-porous) material, e.g., non-porous plastics material.

The filter element (where present) may be a terminal filter element at the downstream/mouth end of the article/consumable.

The filter element may be an upstream filter element, i.e., upstream of the downstream/mouth end of the article/consumable (but downstream of the substrate).

The article/consumable may comprise both a terminal and upstream filter element. The terminal and upstream filter elements may be axially adjacent one another or may be axially spaced. The upstream filter element may be axially adjacent, i.e., immediately downstream of the substrate.

The or each filter element is of a smoke permeable (porous) material such as cellulose acetate or polypropylene tow, paper or plant material.

The or each hollow bore/filter element may be circumscribed with a plug wrap, e.g., a paper plug wrap.

The upstream hollow bore/filter element may be at least partly (e.g., entirely) circumscribed by the (paper) wrapping layer.

The terminal hollow bore/filter element (at the downstream end of the article/consumable) may be joined to the adjacent, upstream elements forming the article/consumable by a circumscribing tipping layer, e.g., a tipping paper layer. The tipping paper may have an axial length longer than the axial length of the terminal hollow bore/filter element such that the tipping paper completely circumscribes the terminal hollow bore/filter element plus the wrapping layer surrounding any adjacent upstream element.

The or each hollow bore/filter element may have a substantially cylindrical shape with a diameter substantially matching the diameter of the aerosol-forming substrate (with or without its associated wrapping layer). The axial length of the or each hollow bore/filter element may be less than 20 mm, e.g., between 8 and 15 mm, for example between 9 and 13 mm, e.g., between 10 and 12 mm.

In some embodiments, the axial length of the terminal hollow bore/filter element is greater than the axial length of the upstream hollow bore/filter element. For example, the axial length of the terminal hollow bore/filter element may be 1 mm or more greater than the axial length of the upstream hollow bore/filter element. The axial length of the terminal hollow bore/filter element may be 2 mm or 3 mm or 4 mm or 5 mm or more greater than the axial length of the upstream hollow bore/filter element.

The axial length of the terminal hollow bore/filter element may be less than 20 mm, e.g., between 8 and 15 mm, for example between 9 and 13 mm, e.g., between 10 and 12 mm such as around 12 mm.

In some embodiments, the upstream hollow bore/filter element may have an axial length of 10 mm or less and the terminal hollow bore/filter element has an axial length greater than 10 mm, e.g., around 12 mm.

Providing a shorter upstream hollow bore/filter element results in a greater concentration of the volatile compound (e.g., CBD) at the terminal hollow bore/filter element because there is less condensation of the volatile compound on the upstream hollow bore/filter element.

In some embodiments, there may be an upstream hollow bore element and a terminal filter element.

In some embodiments, the article/consumable comprises a terminal hollow bore/filter element at the axial downstream end of the article/substrate and one or more of an upstream hollow bore element (as described above), an upstream filter element (as described above), an upstream aerosol-cooling element and an upstream spacer element.

The aerosol-cooling element (where present) is adapted to cool the aerosol generated from the aerosol-forming substrate (by heat exchange) before being inhaled by the user.

The aerosol-cooling element (where present) will be downstream from the aerosol-forming substrate. For example, it may be between the aerosol-forming substrate and the terminal hollow bore/filter element. It may be between the terminal and upstream hollow bore/filter elements. For example, the article/consumable may comprise (in an upstream to downstream direction) the substrate, the upstream hollow bore/filter element, the aerosol-cooling element and the terminal hollow bore/filter element.

The aerosol cooling element may be at least partly (e.g., completely) circumscribed by the (paper) wrapping layer.

The aerosol-cooling element may be formed of a plastics material selected from the group consisting of polylactic acid (PLA), polyvinyl chloride (PVC), polyethylene (PE) and polyethylene terephthalate (PET). The aerosol-cooling element may be formed of a crimped/gathered sheet of material to form a structure having a high surface area with a plurality of longitudinal channels to maximize heat exchange and cooling of the aerosol.

The aerosol cooling element may have an external diameter of between 5 and 10 mm, e.g., between 6 and 9 mm or 6 and 8 mm, e.g., around 7 mm. It may have an axial length of between 10 and 15 mm, e.g., between 12 and 14 mm or 13 and 14 mm, e.g., around 14 mm.

The spacer element (where present) defines a space or cavity or chamber between the aerosol-forming substrate and the downstream end of the article/consumable. The spacer acts to allow both cooling and mixing of the aerosol. It may be provided between the aerosol-forming substrate and the terminal hollow bore/filter element. It may be provided between the terminal and upstream hollow bore/filter elements. For example, the article/consumable may comprise (in an upstream to downstream direction) the substrate, the upstream hollow bore/filter element, the spacer element and the terminal hollow bore/filter element.

The spacer element may comprise a tubular element, e.g., a cardboard tube. The spacer element may be at least partly (e.g., entirely) circumscribed by the (paper) wrapping layer.

The spacer element may have an external diameter of between 5 and 10 mm, e.g., between 6 and 9 mm or 6 and 8 mm, e.g., around 7 mm. It may have an axial length of between 10 and 15 mm, e.g., between 12 and 14 mm or 13 and 14 mm, e.g., around 14 mm.

In a second aspect of the first mode, there is provided a smoking substitute system comprising an aerosol-forming article according to the first aspect of the first mode and a device comprising a heating element.

The device may be a HNB device, i.e., a device adapted to heat but not combust the aerosol-forming substrate.

The device may comprise a main body for housing the heating element. The heating element may comprise an elongated, e.g., rod, tube-shaped or blade heating element. The heating element may project into or surround a cavity within the main body for receiving the article/consumable described above.

The device (e.g., the main body) may further comprise an electrical power supply, e.g., a (rechargeable) battery for powering the heating element. It may further comprise a control unit to control the supply of power to the heating element.

In a third aspect of the first mode, there is provided a method of using a smoking substitute system according to the second aspect of the first mode, the method comprising inserting the article/consumable into the device, and heating the article/consumable using the heating element.

In some embodiments, the method comprises inserting the article/consumable into a cavity within the main body and penetrating the article/consumable with the heating element upon insertion of the article/consumable. For example, the heating element may penetrate the aerosol-forming substrate in the article/consumable.

The skilled person will appreciate that except where mutually exclusive, a feature or parameter described in relation to any one of the above aspects of the first mode may be applied to any other aspect of the first mode. Furthermore, except where mutually exclusive, any feature or parameter of the first mode described herein may be applied to any aspect of the first mode and/or combined with any other feature or parameter of the first mode described herein.

Second Mode: An Aerosol-Forming Article, Wherein the Article Comprises a Substrate at Least Partly Formed of an Extruded Plant Material At its most general, a second mode of the present disclosure relates to an aerosol-forming article, e.g., a consumable for use in a smoking substitute system and particularly, although not exclusively, to a heat-not-burn (HNB) consumable, wherein the article/consumable comprises a substrate at least partly formed of an extruded plant material.

Accordingly, in a first aspect of the second mode, there is provided an aerosol-forming article comprising an aerosol-forming substrate at least partly formed of extruded cannabinoid-containing plant material.

The aerosol-forming substrate is capable of being heated to release at least one cannabinoid compound (e.g., a mixture of cannabinoid compounds) that can form a vapor/aerosol. Extruded plant material is typically more compacted/more dense than other types of plant material typically used in smoking substitute articles. By providing an article having a substrate formed of extruded plant material, the vapor/aerosol will have a higher cannabinoid content than the ground, chopped or loose-leaf plant material used in known articles. In turn, this will provide an increased medicinal or recreational effect to the user.

Optional features will now be set out. These are applicable singly or in any combination with any aspect of the second mode.

(1) Cannabinoid compounds include phyto-cannabinoids which include:

(2) cannabidiol (CBD) and its derivatives/homologues (e.g., cannabidiol mono(m)ethyl ether, cannabidivarin (CBDV), cannabidiorcol, cannabidiolic acid, cannabidivarinic acid);

(3) cannabinodiol (CBND) and its derivatives/homologues (e.g., carrabinodivarin);

(4) cannabigerol (CBG) and its derivatives/homologues (e.g., cannabigerol mono(m)ethyl ether, cannabinerolic acid A, cannabigerovarin, cannabigerolic acid A, cannabigerolic acid A mono(m)ethyl ether, cannabigerovarinic acid A);

(5) cannabinol (CBN) and its derivatives/homologues (e.g., cannabivarin/cannabivarol (CBV), cannabiorcol, cannabinolic acid, cannabinol (m)ethyl ester);

(6) tetrahydrocannabinol (THC) and its derivatives/homologues (e.g., tetrahydrocannabivarin (THCV), tetrahydrocannabiorcol, tetrahydrocannabinolic acid A/B, tetrahydrocannabivarinic acid A, tetrahydrocannabiorcolic acid A/B, isotetrahydrocannabinol, isotetrahydrocannabivarin);

(7) cannabicyclol (CBL) and its derivatives/homologues (e.g., cannabicyclolic acid, cannabicyclovarin);

(8) cannabichromene (CBC) and its derivatives/homologues (e.g., cannabichromenic acid A, cannabichromevarin (CBCV), cannabichromevarinic acid A);

(9) cannabielsoin (CBE) and its derivatives/homologues (e.g., cannabielsoic acid A/B, cannabiglendol, dehydrocannabifuran, cannabifuran);

(10) cannabicitran (CBT) and its derivatives/homologues;

(11) cannabitriol and its derivatives/homologues (e.g., ethyl cannabitriol, dihydroxy-tetrahydrocannabinol, cannabidiolic acid A cannabitriol ester, dihydroxy-hexahydrocannabinol (cannabiripsol), cannabitetrol, oxo-tetrahydrocannabinol); and

(12) cannabichromanone (CBCN) and its derivatives/homologues (e.g., cannabicoumaronone), In some embodiments, the cannabinoid compound is selected from at least one of cannabidiol (CBD) and its derivatives/homologues, e.g., cannabiodiol-$C_5$ (CBD-$C_5$), cannabidiol-$C_4$ (CBD-$C_4$), cannabidiol mono(m)ethyl ether (CBDM-$C_5$), cannabidivarin (CBDV-$C_3$), cannabidiorcol (CBD-$C_1$), cannabidiolic acid (CBDA-$C_5$), cannabidivarinic acid (CBDVA-$C_3$).

In some embodiments, the cannabinoid compound is selected from at least one of tetrahydrocannabinol (THC) and its derivatives/homologues, e.g., $\Delta^9$-tetrahydrocannabinol ($\Delta^9$-THC-$C_5$/cis-$\Delta^9$-THC-$C_5$), $\Delta^9$-tetrahydrocannabinol ($\phi^8$-THC-$C_5$), $\Delta^9$-tetrahydrocannabinolic acid A ($\Delta^9$-THCA-$C_5$ A), $\Delta^9$-tetrahydrocannabinol-$C_4$ ($\Delta^9$-THC-$C_4$), $\Delta^9$-tetrahydrocannabivarin ($\Delta^9$-THCV-$C_3$), $\Delta^9$-tetrahydrocannabiorcol ($\Delta^9$-THCO-$C_1$), $\Delta^9$-tetrahydrocannabinolic acid A ($\Delta^9$-THCA-$C_5$ A), $\Delta^9$-tetrahydrocannabinolic acid B ($\Delta^9$-THCA-$C_5$ B), $\Delta^9$-tetrahydrocannabinolic acid-$C_4$ A and/or B ($\Delta^9$-THCA-$C_4$ A and/or B), $\Delta^9$-tetrahydrocannabivarinic acid A ($\Delta^9$-THCVA-$C_3$ A), $\Delta^9$-tetrahydrocannabiorcolic acid A and/or B ($\Delta^9$-THCOA-$C_1$ A and/or B), isotetrahydrocannabinol and isotetrahydrocannabivarin.

The total amount of cannabinoid compounds in the substrate may be at least 200 mg; for example, it may be at least 250 mg, at least 300 mg, at least 400 mg, at least 500 mg. In some cases, lower amounts may be preferred. The total amount of cannabinoid compounds in the substrate may therefore be at least 10 mg, at least 20 mg, at least 30 mg, at least 40 mg, at least 50 mg, at least 75 mg, at least 100 mg.

In some cases, it may be desirable to limited the total amount of cannabinoid compounds, which may be not more than 200 mg, not more than 175 mg, not more than 150 mg, not more than 125 mg, not more than 100 mg, not more than 75 mg, not more than 50 mg, not more than 40 mg, not more than 30 mg, not more than 20 mg, not more than 10 mg. In some cases, the total amount of the cannabinoid compounds may be not more than 5 mg.

Where THC is included, either as one cannabinoid compound in a mixture or as the only cannabinoid, the total of amount of THC may be limited. In some cases, the total amount of THC in the substrate is not more than 100 mg, not more than 75 mg, not more than 50 mg, not more than 40 mg, not more than 30 mg, not more than 20 mg, not more than 15 mg, not more than 10 mg, not more than 5 mg, not more than 3 mg. In some cases, the amount of THC may be 0.1 to 30 mg, for example 1 to 30 mg, for example 1 to 20 mg, for example 1 to 10 mg, for example 1 to 5 mg, for example 1 to 3 mg.

The cannabinoid-containing plant material may comprise *cannabis* plant material including *Cannabis sativa, Cannabis indica* and *Cannabis rudealis.*

The cannabinoid-containing plant material may comprise *Echinacea purpurea, Echinacea angustifolia, Acmella oleracea, Helichrysum umbraculigerum*, or *Radula marginata*. This also includes blends of the above-mentioned plant material.

Preferably the cannabinoid-containing plant material is *cannabis.*

The cannabinoid-containing (e.g., *cannabis*) plant may be a traditional strain, or may be a strain bred or other modified (e.g., genetically) to produce certain levels of some cannabinoid compounds, e.g., low levels of THC or high levels of THC.

Any suitable parts of the cannabinoid-containing plant may be used. Thus, the cannabinoid-containing plant material may comprise leaves, stems, roots, bark, seeds, buds and flowers (which may be cured).

The aerosol-forming substrate may comprise at least 50 wt % plant material, e.g., at least 60 wt % plant material, e.g., around 65 wt % plant material. The aerosol-forming substrate may comprise 80 wt % or less plant material, e.g., 75 or 70 wt % or less plant material.

The substrate may at least partly comprise a rod of extruded cannabinoid-containing (e.g., *cannabis*) plant material. The rod of extruded cannabinoid-containing (e.g., *cannabis*) plant material may comprise an axial bore adapted to receive an external heating element. By providing an aerosol-forming substrate formed of or comprising a rod of extruded cannabinoid-containing plant material having an empty axial bore for receiving an external heating element, the user of a smoking substitute system having an external heater is provided with an aerosol having an increased concentration of cannabinoid compounds and thus an enhanced medicinal/recreational effect.

The substrate may at least partly comprise pellets/granules/chips of extruded cannabinoid-containing (e.g., *cannabis*) plant material. In contrast to powdered plant material, each pellet/chip/granule is of a macroscopic size (e.g., having a smallest dimension of greater than 0.5 mm or 1 mm).

Extruded cannabinoid-containing (e.g., *cannabis*) plant material can be produced by forming a liquid mixture of powered plant material and a binding agent such as a gum (e.g., xanthan, guar, Arabic and/or locust bean gum). The liquid mixture is heated and then extruded through a die. The extrudate is dried and then may be subsequently cut into pellets, chips or granules.

The aerosol-forming article is preferably a heat-not-burn (HNB) consumable.

The aerosol-forming substrate may be located at an upstream axial end of the article/consumable.

As used herein, the terms "upstream" and "downstream" are intended to refer to the flow direction of the vapor/aerosol, i.e., with the downstream end of the article/consumable being the mouth end or outlet where the aerosol exits the article/consumable for inhalation by the user. The upstream end of the article/consumable is the opposing end to the downstream end.

The aerosol-forming substrate may be at least partly circumscribed by a wrapping layer, e.g., a paper wrapping layer.

The aerosol-forming substrate may be formed in a substantially cylindrical shape such that the article/consumable resembles a conventional cigarette. It may have a diameter of between 5 and 10 mm, e.g., between 6 and 9 mm or 6 and 8 mm, e.g., around 7 mm. It may have an axial length of between 10 and 15 mm, e.g., between 11 and 14 mm such as around 12 or 13 mm.

The article/consumable may comprise one or more of a hollow bore element, a filter element, a spacer element and/or a cooling element downstream of the substrate.

The hollow bore element comprises a hollow bore which extends the axial length of the hollow bore element.

The hollow bore element may be a terminal hollow bore element at the downstream/mouth end of the article/consumable. In these embodiments, the hollow bore terminates at the downstream/mouth end of the article/consumable.

The hollow bore element may be an upstream hollow bore element, i.e., upstream of the downstream/mouth end of the article/consumable (but downstream of the substrate).

The article/consumable may comprise both a terminal and upstream hollow bore element. The terminal and upstream hollow bore elements may be axially adjacent one another or may be axially spaced. The upstream hollow bore element may be axially adjacent, i.e., immediately downstream of the substrate.

The or each hollow bore element may have an axial bore, i.e., aligned with the axis of the hollow bore element. The or each hollow bore may have a bore diameter of between 1 and 5 mm, e.g., between 2 and 4 mm or between 2 and 3 mm.

The or each hollow bore element may be formed of a smoke permeable (porous) material such as cellulose acetate or polypropylene tow, paper or plant material or may be formed of smoke impermeable (non-porous) material, e.g., non-porous plastics material.

The or each hollow bore element may be circumscribed with a plug wrap, e.g., a paper plug wrap.

The upstream hollow bore element may be at least partly (e.g., entirely) circumscribed by the (paper) wrapping layer.

The terminal hollow bore element (at the downstream end of the article/consumable) may be joined to the adjacent, upstream elements forming the article/consumable by a circumscribing tipping layer, e.g., a tipping paper layer. The tipping paper may have an axial length longer than the axial length of the terminal hollow bore element such that the tipping paper completely circumscribes the terminal hollow bore element plus the wrapping layer surrounding any adjacent upstream element.

The or each hollow bore element may have a substantially cylindrical shape with a diameter substantially matching the diameter of the aerosol-forming substrate (with or without its associated wrapping layer). The axial length of the or each hollow bore element may be less than 20 mm, e.g., between 8 and 15 mm, for example between 9 and 13 mm, e.g., between 10 and 12 mm.

The filter element may be a terminal filter element at the downstream/mouth end of the article/consumable.

The filter element may be an upstream filter element, i.e., upstream of the downstream/mouth end of the article/consumable (but downstream of the substrate).

The article/consumable may comprise both a terminal and upstream filter element. The terminal and upstream filter elements may be axially adjacent one another or may be axially spaced. The upstream filter element may be axially adjacent, i.e., immediately downstream of the substrate.

The or each filter element is of a smoke permeable (porous) material such as cellulose acetate or polypropylene tow, paper or plant material.

The or each filter element may be circumscribed with a plug wrap, e.g., a paper plug wrap.

The upstream filter element may be at least partly (e.g., entirely) circumscribed by the (paper) wrapping layer.

The terminal filter element (at the downstream end of the article/consumable) may be joined to the adjacent, upstream elements forming the article/consumable by a circumscribing tipping layer, e.g., a tipping paper layer. The tipping paper may have an axial length longer than the axial length of the terminal filter element such that the tipping paper completely circumscribes the terminal filter element plus the wrapping layer surrounding any adjacent upstream element.

The or each filter element may have a substantially cylindrical shape with a diameter substantially matching the diameter of the aerosol-forming substrate (with or without its associated wrapping layer). The axial length of the or each filter element may be less than 20 mm, e.g., between 8 and 15 mm, for example between 9 and 13 mm, e.g., between 10 and 12 mm.

In some embodiments, there may be an upstream hollow bore element and a terminal filter element.

In some embodiments, the article/consumable may comprise an aerosol-cooling element which is adapted to cool the aerosol generated from the aerosol-forming substrate (by heat exchange) before being inhaled by the user.

The aerosol-cooling element will be downstream from the aerosol-forming substrate. For example, it may be between the aerosol-forming substrate and the terminal hollow bore/filter element and/or between the terminal and upstream hollow bore/filter elements. The aerosol cooling element may be at least partly (e.g., completely) circumscribed by the (paper) wrapping layer.

The aerosol-cooling element may be formed of a plastics material selected from the group consisting of polylactic acid (PLA), polyvinyl chloride (PVC), polyethylene (PE) and polyethylene terephthalate (PET). The aerosol-cooling element may be formed of a crimped/gathered sheet of material to form a structure having a high surface area with a plurality of longitudinal channels to maximize heat exchange and cooling of the aerosol.

The aerosol cooling element may have an external diameter of between 5 and 10 mm, e.g., between 6 and 9 mm or 6 and 8 mm, e.g., around 7 mm. It may have an axial length of between 10 and 15 mm, e.g., between 12 and 14 mm or 13 and 14 mm, e.g., around 14 mm.

The article/consumable may comprise a spacer element that defines a space or cavity or chamber between the aerosol-forming substrate and the downstream end of the article/consumable. The spacer acts to allow both cooling and mixing of the aerosol. It may be provided between the aerosol-forming substrate and the terminal hollow bore/filter element and/or between the terminal and upstream hollow bore/filter elements. The spacer element may comprise a tubular element, e.g., a cardboard tube. The spacer element may be at least partly (e.g., entirely) circumscribed by the (paper) wrapping layer.

The spacer element may have an external diameter of between 5 and 10 mm, e.g., between 6 and 9 mm or 6 and 8 mm, e.g., around 7 mm. It may have an axial length of between 10 and 15 mm, e.g., between 12 and 14 mm or 13 and 14 mm, e.g., around 14 mm.

In a second aspect of the second mode, there is provided a smoking substitute system comprising an aerosol-forming article according to the first aspect of the second mode and a device comprising a heating element.

The device may be a HNB device, i.e., a device adapted to heat but not combust the aerosol-forming substrate.

The device may comprise a main body for housing the heating element. The heating element may comprise an elongated, e.g., rod, tube-shaped or blade heating element. The heating element may project into or surround a cavity within the main body for receiving the article/consumable described above.

Where present, the diameter of the axial bore of the extruded rod of cannabinoid-containing (e.g., *cannabis*) plant material preferably matches the diameter of the elongated rod/tube heater.

The device (e.g., the main body) may further comprise an electrical power supply, e.g., a (rechargeable) battery for powering the heating element. It may further comprise a control unit to control the supply of power to the heating element.

In a third aspect of the second mode, there is provided a method of using a smoking substitute system according to the second aspect of the second mode, the method comprising inserting the article/consumable into the device, and heating the article/consumable using the heating element.

In some embodiments, the method comprises inserting the article/consumable into a cavity within the main body and penetrating the article/consumable with the heating element upon insertion of the article/consumable. For example, the heating element may penetrate the aerosol-forming substrate in the article/consumable.

The skilled person will appreciate that except where mutually exclusive, a feature or parameter described in relation to any one of the above aspects of the second mode may be applied to any other aspect of the second mode. Furthermore, except where mutually exclusive, any feature or parameter of the second mode described herein may be applied to any aspect of the second mode and/or combined with any other feature or parameter of the second mode described herein.

SUMMARY OF THE FIGURES

So that the disclosure may be understood, and so that further aspects and features thereof may be appreciated, embodiments illustrating the principles of the disclosure will now be discussed in further detail with reference to the accompanying figures, in which.

DETAILED DESCRIPTION OF THE FIGURES

Figure 1:
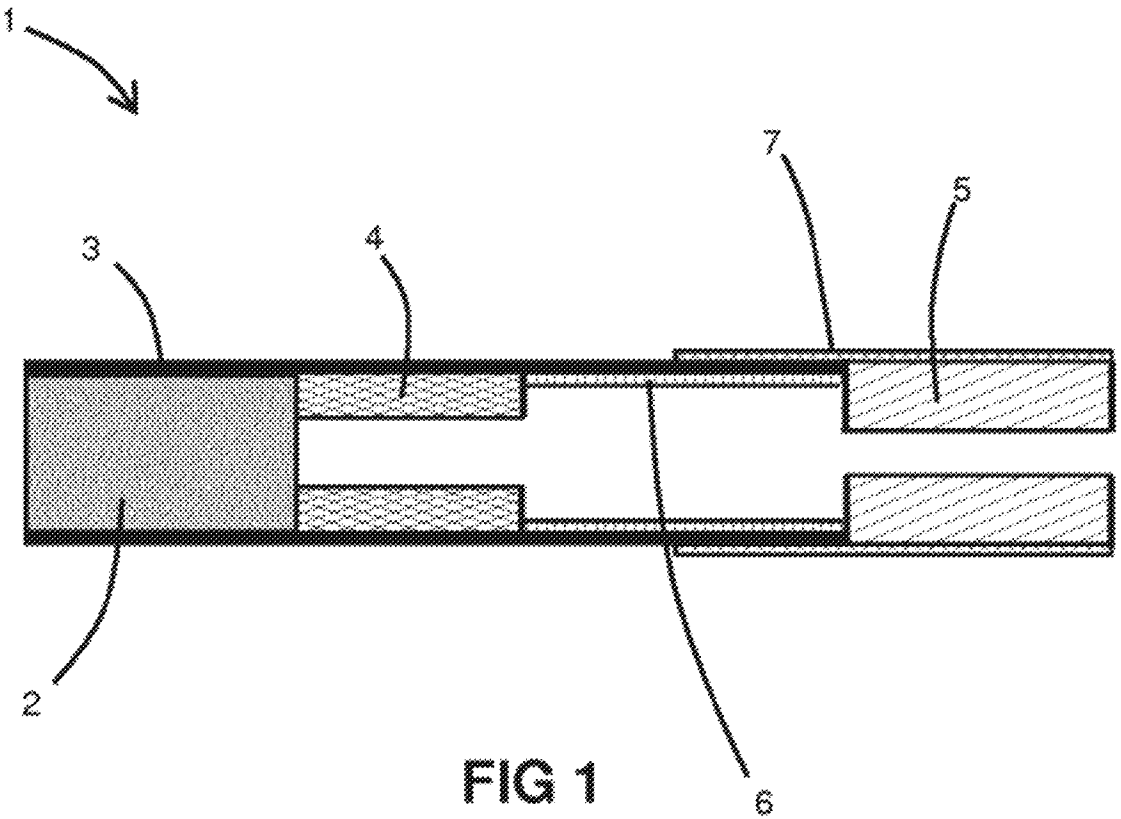
FIG. 1 shows a first embodiment of the first mode of an HNB consumable.

First Mode: An Aerosol-Forming Article, Wherein the Article Comprises a Substrate Comprising a Cannabinoid-Containing Plant Material As shown in FIG. 1, the HNB consumable 1 comprises a solid (un-bored) aerosol-forming substrate 2 at the upstream end of the consumable 1.

The aerosol-forming substrate comprises *cannabis* plant material which includes the cannabinoid CBD as a volatile compound.

The aerosol-forming substrate 2 comprises 65 wt % *cannabis* plant material which is provided in the form of a gathered sheet of homogenized (e.g., slurry/paper recon) *cannabis* plant material or gathered shreds formed from such a sheet.

The aerosol-forming substrate 2 is formed in a substantially cylindrical shape such that the consumable resembles a conventional cigarette. It has diameter of around 7 mm and an axial length of around 12 mm.

The aerosol-forming substrate 2 is circumscribed by a paper wrapping layer 3.

The consumable 1 comprises an upstream hollow bore element 4 and a downstream terminal hollow bore element 5. The two elements 4, 5 are spaced by a cardboard spacer tube 6. Both elements 4, 5 are formed of cellulose acetate tow and wrapped with a respective paper plug layer (not shown).

Both elements 4, 5 have a substantially cylindrical shape. The diameter of the upstream hollow bore element 4 matches the diameter of the aerosol-forming substrate 2. The diameter of the terminal hollow bore element 5 is slightly larger and matches the combined diameter of the aerosol-forming substrate 2 and the wrapping layer 3. The upstream hollow bore element 4 is slightly shorter in axial length than the terminal hollow bore element 5 at an axial length of 10 mm compared to 12 mm for the terminal hollow bore element 5. The cardboard spacer tube 6 is longer having an axial length of around 14 mm.

Each hollow bore element 4, 5 has a hollow, longitudinally extending bore. The diameter of the bore in the upstream hollow bore element 4 is slightly larger than the diameter of the bore in the terminal hollow bore element 5 having a diameter of 3 mm compared to 2 mm for the terminal hollow bore element 5.

The cardboard spacer tube 6 and the upstream hollow bore element 4 are circumscribed by the wrapping layer 3.

The terminal hollow bore element 5 is joined to the adjacent, upstream elements forming the consumable by a circumscribing paper tipping layer 7. The tipping layer 7 encircles the terminal hollow bore element 5 and has an axial length of around 20 mm such that it overlays a portion of the cardboard spacer tube 6.

The terminal hollow bore element 5 has a greater hardness (95%) than the upstream hollow bore element 4 hardness (90%).

Figure 2:
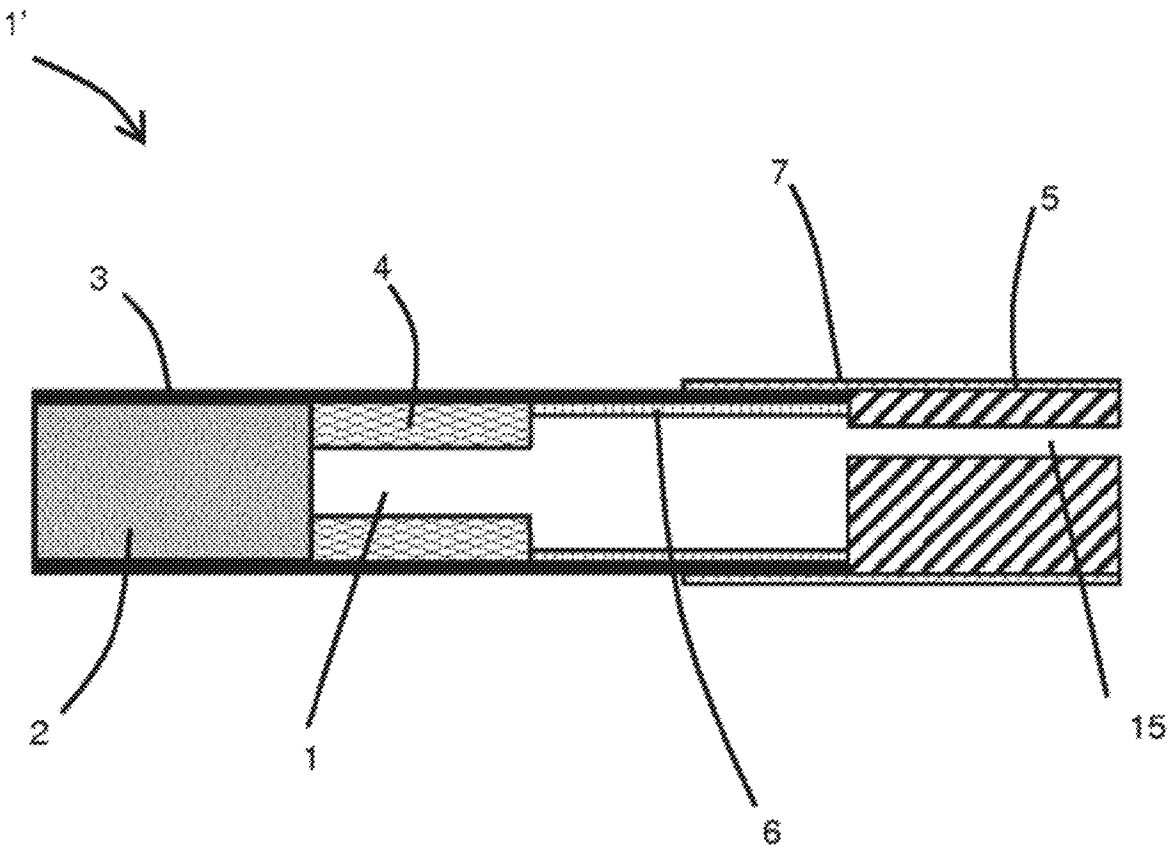
FIG. 2 shows a second embodiment of the first mode of an HNB consumable.

FIG. 2 shows a second embodiment of a consumable 1' which is the same as the first embodiment except that the terminal hollow bore element 5 has an axially off-set hollow bore 15.

Figure 3:
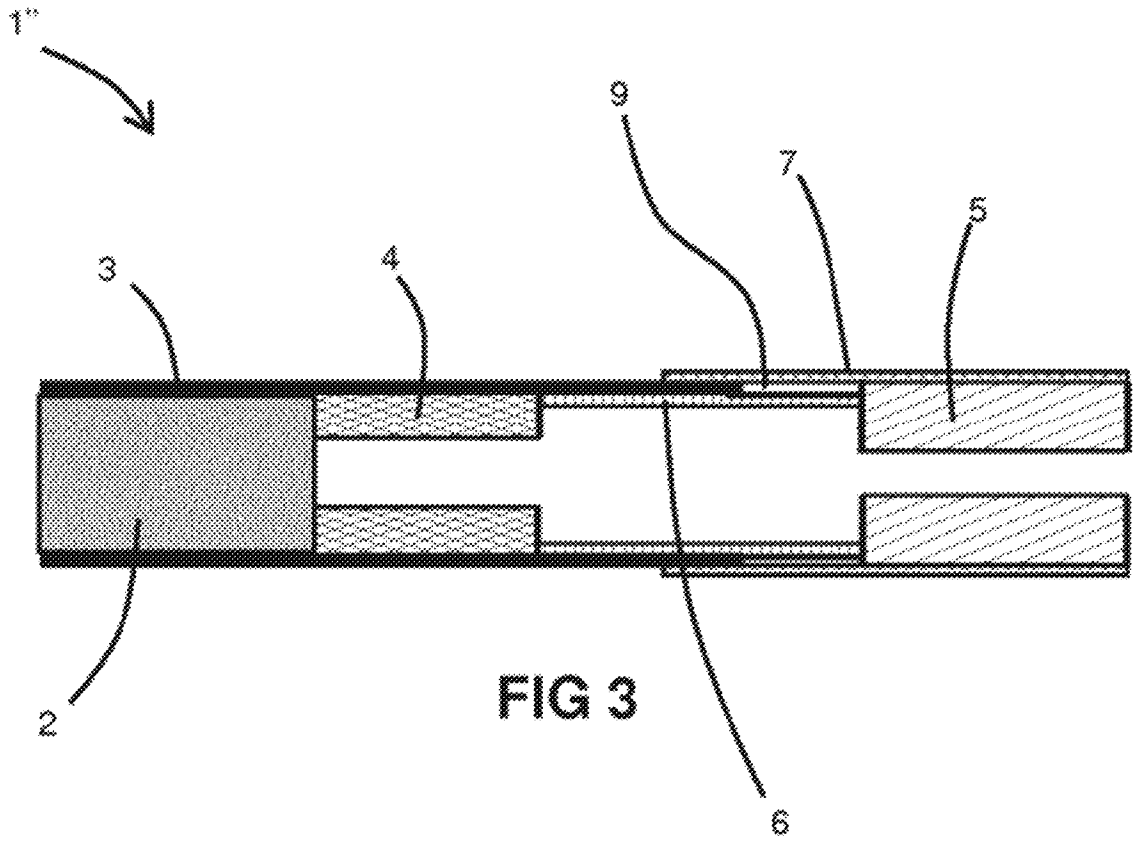
FIG. 3 shows a third embodiment of the first mode of an HNB consumable.

FIG. 3 shows a third embodiment of a consumable 1" which is the same as the first embodiment except that the wrapping layer 3 does not completely circumscribe the cardboard spacer tube 6 such that there is an annular gap 9 between the tipping layer 7 and the cardboard spacer tube 6 downstream of the end of the wrapping layer 3.

Figure 4:
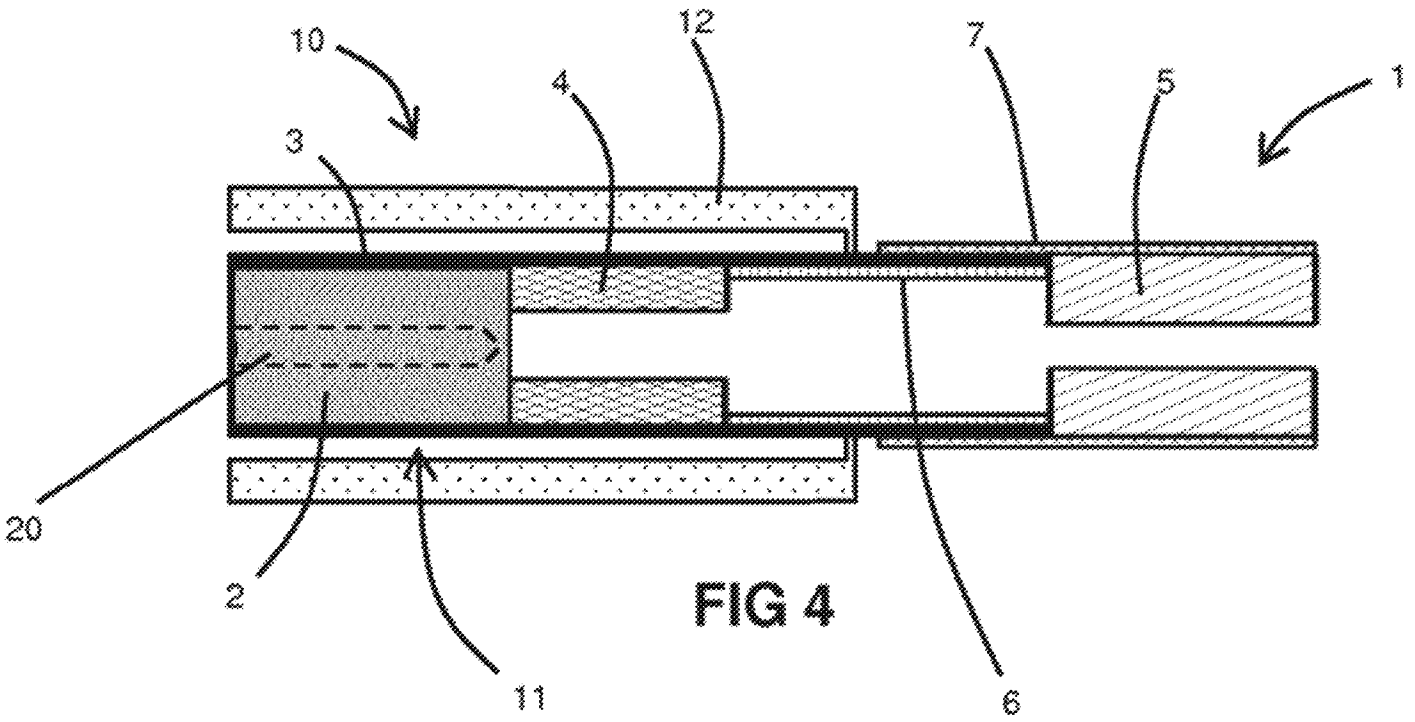
FIG. 4 shows the first embodiment of the first mode within a device forming an HNB system.

FIG. 4 shows the first embodiment inserted into an HNB device 10 comprising a rod-shaped heating element 20 (shown in dashed lines). The heating element 20 projects into a cavity 11 within the main body 12 of the device.

The consumable 1 is inserted into the cavity 11 of the main body 12 of the device 10 such that the heating rod penetrates the aerosol-forming substrate 2. Heating of the *cannabis* plant material in the aerosol-forming substrate 2 is affected by powering the heating element 20 (e.g., with a rechargeable battery (not shown)). As the *cannabis* plant material is heated, moisture and volatile compound (e.g., CBD) within the *cannabis* plant material is released as a vapor and entrained within an airflow generated by inhalation by the user at the terminal hollow bore element 5.

As the vapor cools within the upstream hollow bore element 4 and the cardboard spacer tube 6, it condenses to form an aerosol containing the volatile compounds for inhalation by the user.

Figure 5:
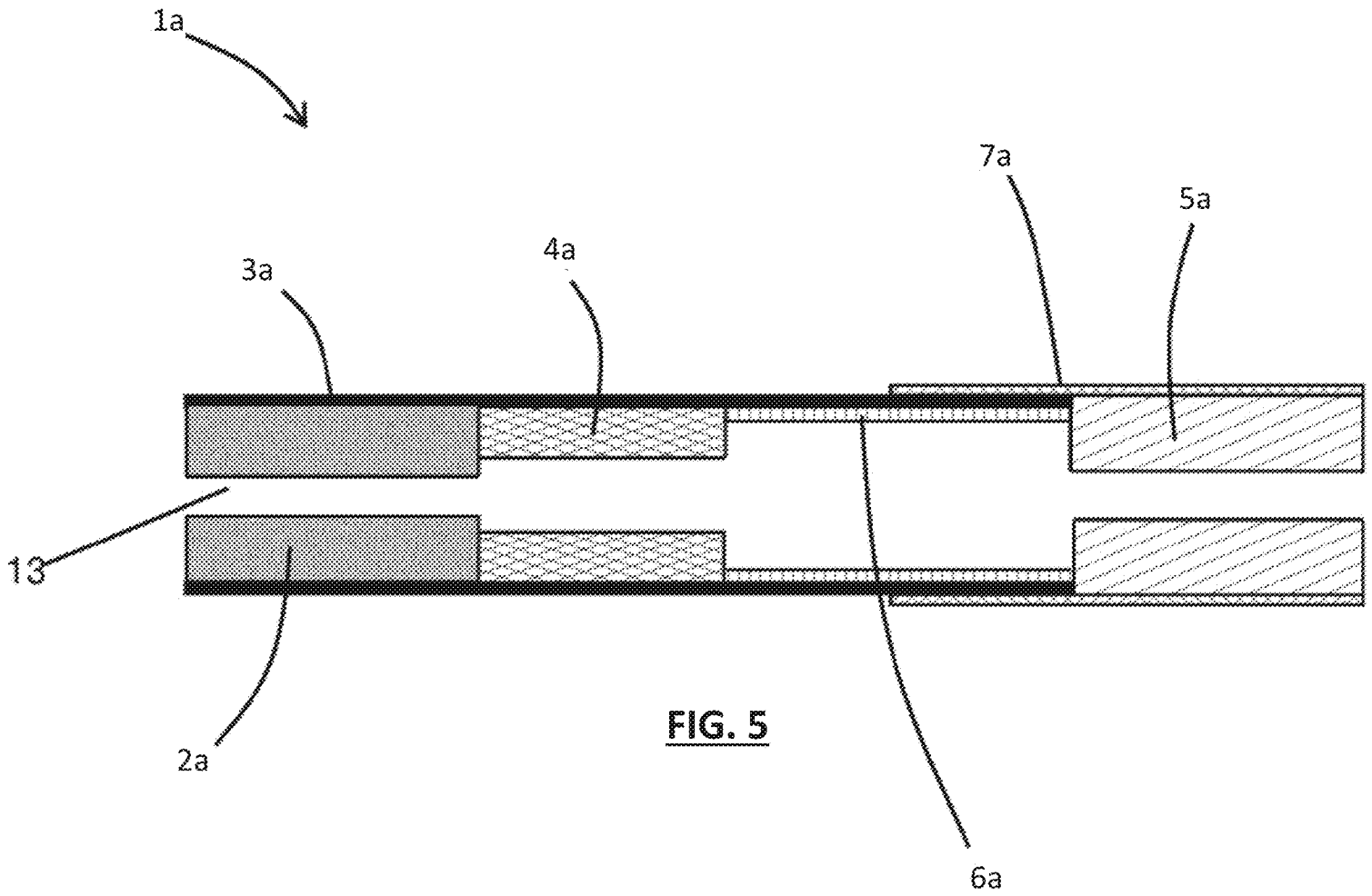
FIG. 5 shows a first embodiment of the second mode of an HNB consumable.

Second Mode: An Aerosol-Forming Article, Wherein the Article Comprises a Substrate at Least Partly Formed of an Extruded Plant Material As shown in FIG. 5, the HNB consumable 1*a* comprises an aerosol-forming substrate 2*a* at the upstream end of the consumable 1*a*.

The aerosol-forming substrate 2*a* comprises a rod-shaped extrudate of *cannabis* which includes the cannabinoid CBD as a volatile compound.

The aerosol-forming substrate 2*a* is formed in a substantially cylindrical shape such that the consumable resembles a conventional cigarette. It has diameter of around 7 mm and an axial length of around 12 mm. The extrudate comprises an axial bore 13 which has its axial upstream end at the axial upstream end of the aerosol-forming substrate 2*a*. The axial bore 13 extends the entire length of the extrudate and thus has an axial length of 12 mm. It has a bore diameter of around 2 mm.

The aerosol-forming substrate 2*a* is circumscribed by a paper wrapping layer 3*a*.

The consumable 1*a* comprises an upstream hollow bore element 4*a* and a downstream terminal hollow bore element 5*a*. The two elements 4*a*, 5*a* are spaced by a cardboard spacer tube 6*a*. Both elements 4*a*, 5*a* are formed of cellulose acetate tow and wrapped with a respective paper plug layer (not shown).

Both elements 4*a*, 5*a* have a substantially cylindrical shape. The diameter of the upstream hollow bore element 4*a* matches the diameter of the aerosol-forming substrate 2*a*. The diameter of the terminal hollow bore element 5*a* is slightly larger and matches the combined diameter of the aerosol-forming substrate 2*a* and the wrapping layer 3*a*. The upstream hollow bore element 4*a* is slightly shorter in axial length than the terminal hollow bore element 5*a* at an axial length of 10 mm compared to 12 mm for the terminal hollow bore element 5*a*. The cardboard spacer tube 6*a* is longer having an axial length of around 14 mm.

Each hollow bore element 4*a*, 5*a* has a hollow, longitudinally extending bore. The diameter of the bore in the upstream hollow bore element 4*a* is slightly larger than the diameter of the bore in the terminal hollow bore element 5*a* having a diameter of 3 mm compared to 2 mm for the terminal hollow bore element 5*a*.

The cardboard spacer tube 6*a* and the upstream hollow bore element 4*a* are circumscribed by the wrapping layer 3*a*.

The terminal hollow bore element 5*a* is joined to the adjacent, upstream elements forming the consumable by a circumscribing paper tipping layer 7*a*. The tipping layer 7*a* encircles the terminal hollow bore element 5*a* and has an axial length of around 20 mm such that it overlays a portion of the cardboard spacer tube 6*a*.

Figure 6:
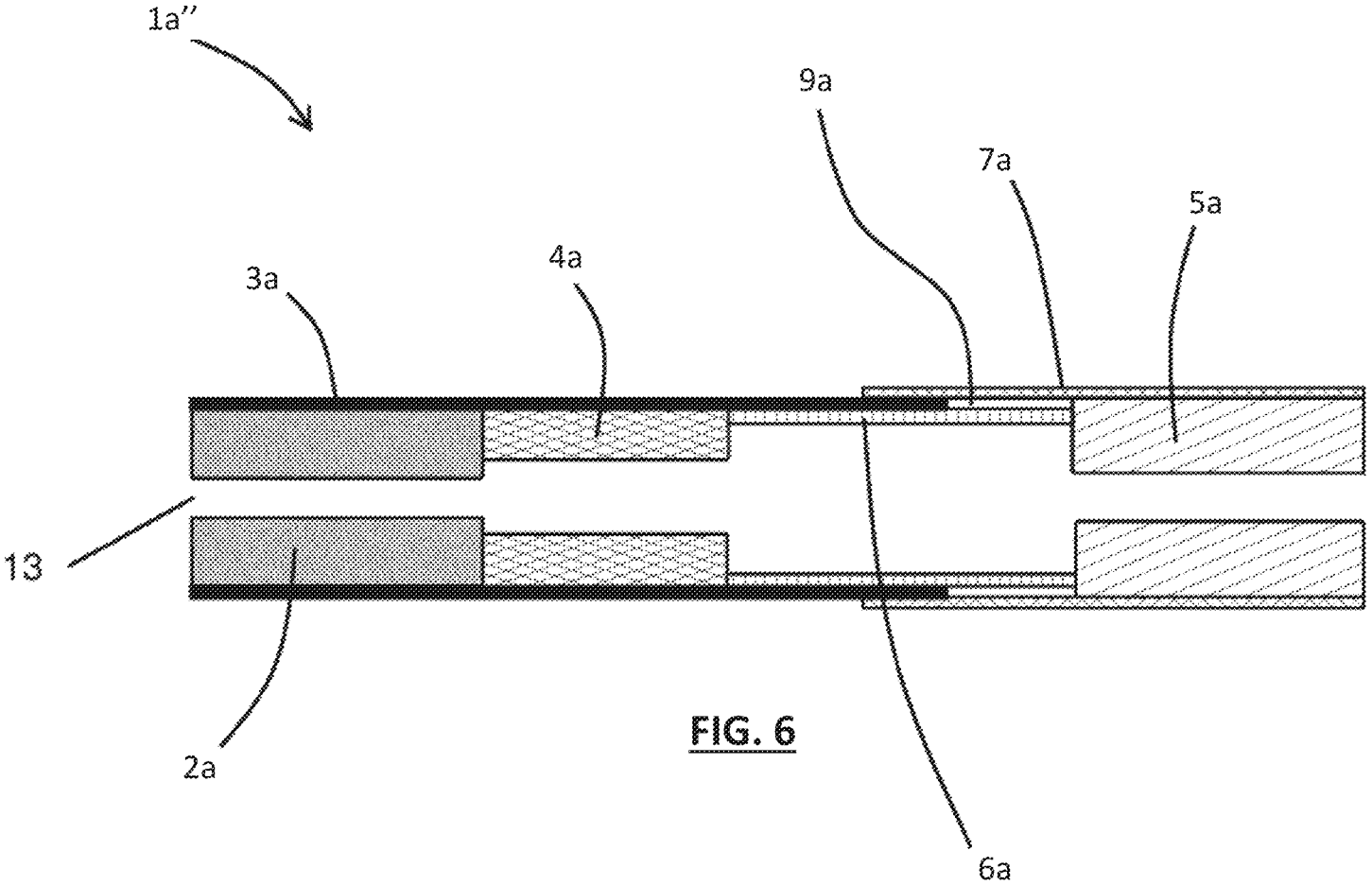
FIG. 6 shows a second embodiment of the second mode of an HNB consumable.

FIG. 6 shows a second embodiment of a consumable 1*a*" which is the same as the first embodiment except that the wrapping layer 3*a* does not completely circumscribe the cardboard spacer tube 6*a* such that there is an annular gap 9*a* between the tipping layer 7*a* and the cardboard spacer tube 6*a* downstream of the end of the wrapping layer 3*a*.

Figure 7:
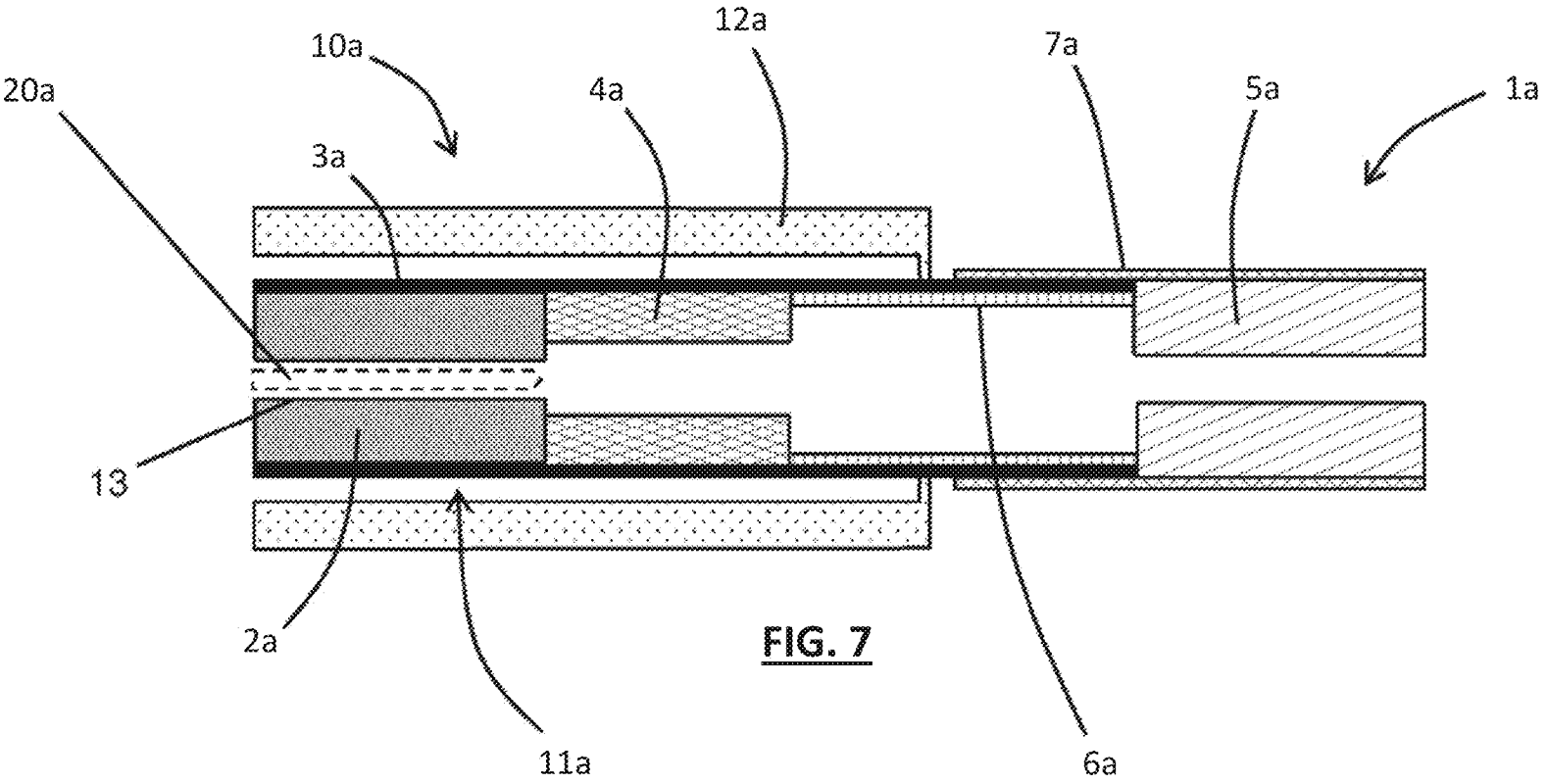
FIG. 7 shows the first embodiment of the second mode within a device forming an HNB system.

FIG. 7 shows the first embodiment inserted into an HNB device 10*a* comprising a rod-shaped heating element 20*a* (shown in dashed lines). The heating element 20*a* projects into a cavity 11*a* within the main body 12*a* of the device.

The consumable 1*a* is inserted into the cavity 11*a* of the main body 12*a* of the device 10*a* such that the heating rod 20*a* is received in the axial bore 13*a* of the aerosol-forming substrate 2*a*. Heating of the *cannabis* plant material in the aerosol-forming substrate 2*a* is affected by powering the heating element 20*a* (e.g., with a rechargeable battery (not shown)). As the *cannabis* plant material is heated, moisture and volatile compound (e.g., CBD) within the *cannabis* plant material is released as a vapor and entrained within an airflow generated by inhalation by the user at the terminal hollow bore element 5*a*.

As the vapor cools within the upstream hollow bore element 4*a* and the cardboard spacer tube 6*a*, it condenses to form an aerosol containing the volatile compounds for inhalation by the user.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the scope of the disclosure.

For the avoidance of any doubt, any theoretical explanations provided herein are provided for the purposes of improving the understanding of a reader. The inventors do not wish to be bound by any of these theoretical explanations.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

What is claimed is:

1. An aerosol-forming article comprising an aerosol-forming substrate at least partly formed of extruded cannabinoid-containing plant material, wherein the aerosol-forming article comprises an airflow path extending downstream from a downstream axial end of the aerosol-forming substrate to an outlet, wherein the aerosol-forming substrate comprises an axial bore extending across an entire axial length of the aerosol-forming substrate.

2. The aerosol-forming article according to claim 1 wherein the cannabinoid containing plant material comprises one or more cannabinoids selected from cannabidiol (CBD) and its derivatives/homologues, cannabinodiol (CBND) and its derivatives/homologues, cannabigerol (CBG) and its derivatives/homologues, cannabinol (CBN) and its derivatives/homologues, tetrahydrocannabinol (THC) and its derivatives/homologues, cannabicyclol (CBL) and its derivatives/homologues, cannabichromene (CBC) and its derivatives/homologues, cannabielsoin (CBE) and its derivatives/homologues, cannabicitran (CBT) and its derivatives/homologues, cannabitriol and its derivatives/homologues and cannabichromanone (CBCN) and its derivatives/homologues.

3. The aerosol-forming article according to claim 1 wherein the extruded cannabinoid-containing plant material is *cannabis* plant material.

4. The aerosol-forming article according to claim 1 wherein the aerosol-forming substrate at least partly comprises a rod of extruded cannabinoid-containing plant material.

5. The aerosol-forming article according to claim 1 wherein the axial bore is adapted to receive an external heating element.

6. The aerosol-forming article according to claim 1 wherein the aerosol-forming substrate at least partly comprises pellets/granules/chips of extruded cannabinoid-containing plant material.

7. The aerosol-forming article according to claim 1 wherein the aerosol-forming article is a heat-not-burn (HNB) consumable.

8. The aerosol-forming article according to claim 1 wherein the aerosol-forming article comprises a terminal hollow bore element or terminal filter element at the downstream/mouth end of the aerosol-forming article.

9. The aerosol-forming article according to claim 8 wherein the aerosol-forming article comprises the terminal filter element, and further comprising an upstream hollow bore element or upstream filter element axially spaced from the terminal filter element.

10. The aerosol-forming article according to claim 8 further comprising one or more of a spacer element and an aerosol-cooling element.

11. A smoking substitute system comprising an aerosol-forming article according to claim 1 and a device comprising a heating element.

12. A system according to claim 11 wherein the device comprises a main body for housing the heating element and the heating element comprises an elongated heating element.

13. A method of using a smoking substitute system according to claim 11, the method comprising inserting the aerosol-forming article into the device, and heating the aerosol-forming article using the heating element.

14. A method according to claim 13 comprising inserting the aerosol-forming article into a cavity within a main body of the device and penetrating the aerosol-forming substrate with the heating element upon insertion of the aerosol-forming article.

15. A method according to claim 14 wherein the aerosol-forming substrate comprises a rod of extruded cannabinoid-containing plant material and wherein the heating element is inserted into the axial bore.

16. The aerosol-forming article according to claim 1 wherein the aerosol-forming article comprises a terminal hollow bore element at the outlet and an upstream hollow bore element axially spaced from the terminal hollow bore element, wherein the terminal hollow bore element has a first inner surface defining a first portion of the airflow path, and the upstream hollow bore element has a second inner surface defining a second portion of the airflow path.

17. The aerosol-forming article according to claim 16, wherein the upstream hollow bore element is positioned adjacent to the aerosol-forming substrate.

18. The aerosol-forming article according to claim 16, wherein the upstream hollow bore element contacts the aerosol-forming substrate.

19. The aerosol-forming article according to claim 16, further comprising a spacer element between the terminal hollow bore element and the upstream hollow bore element.

20. The aerosol-forming article according to claim 16, further comprising an aerosol-cooling element downstream of the aerosol-forming substrate.

* * * * *